US010727038B2

(12) United States Patent
Kahen et al.

(10) Patent No.: US 10,727,038 B2
(45) Date of Patent: Jul. 28, 2020

(54) ION FLOW GUIDE DEVICES AND METHODS

(71) Applicants: Kaveh Kahen, Maple (CA); Hamid Badiei, Woodbridge (CA)

(72) Inventors: Kaveh Kahen, Maple (CA); Hamid Badiei, Woodbridge (CA)

(73) Assignee: PerkinElmer Health Sciences Canada, Inc., Woodbridge, (ON) (GB)

( * ) Notice: Subject to any disclaimer, the term of this patent is extended or adjusted under 35 U.S.C. 154(b) by 0 days.

(21) Appl. No.: 16/252,667

(22) Filed: Jan. 20, 2019

(65) Prior Publication Data

US 2019/0333749 A1 Oct. 31, 2019

Related U.S. Application Data

(63) Continuation of application No. 14/060,120, filed on Oct. 22, 2013, now abandoned.

(60) Provisional application No. 61/717,572, filed on Oct. 23, 2012.

(51) Int. Cl.
*H01J 49/06* (2006.01)

(52) U.S. Cl.
CPC ..... *H01J 49/063* (2013.01)

(58) Field of Classification Search
CPC ..... H01J 49/063; H01J 49/0095; H01J 49/22; H01J 49/408; H01J 49/48
See application file for complete search history.

(56) References Cited

U.S. PATENT DOCUMENTS 6,891,157 B2 * 5/2005 Bateman ..... H01J 49/065 250/292
2003/0155498 A1 * 8/2003 Kato ..... H01J 49/0095 250/281

OTHER PUBLICATIONS

Lindahl et al., 'Depletion of the excited state population in negative ions using laser photodetachment in a gas-filled RF quadrupole ion guide' 2010 J. Phys. B: At. Mol. Opt. Phys. 43 115008 (Year: 2010).*

Klinkmuller et al., 'Photodetachnnent study of He-quartet resonances below the He(n=3) thresholds' J. Phys. B Atm. Mol. and Opt. Phys., Jun. 1998, 31:2549-2557 (Year: 1998).*

* cited by examiner

*Primary Examiner* — Eliza W Osenbaugh-Stewart
(74) *Attorney, Agent, or Firm* — Rhodes IP PLC; Christopher R Rhodes

(57) ABSTRACT

Certain configurations of devices are described herein that include DC multipoles that are effective to direct ions. In some instances, the devices include a first multipole configured to provide a DC electric field effective to direct first ions of an entering particle beam along a first exit trajectory that is substantially orthogonal to an entry trajectory of the particle beam. The devices may also include a second multipole configured to provide a DC electric field effective to direct the received first ions from the first multipole along a second exit trajectory that is substantially orthogonal to the first exit trajectory.

16 Claims, 5 Drawing Sheets

ION FLOW GUIDE DEVICES AND METHODS

PRIORITY APPLICATION

The application claims priority to, and the benefit of, U.S. Provisional Application No. 61/717,572 filed on Oct. 23, 2012, the entire disclosure of which is hereby incorporated herein by reference for all purposes.

TECHNOLOGICAL FIELD

Aspects and features of the present technology relate generally to methods and devices for directing ions, and more particularly for deflecting ions within a particle stream along a desired path.

BACKGROUND

Ions may be directed along a path by exposing the ions to electric and/or magnetic fields. The utilization of such fields to guide ions has numerous practical applications. A common use of multipole ion flow guides within analytical chemistry is as mass analyzers within mass spectrometers. A mass spectrometer is a device that identifies ions according to their mass-to-charge ratio. As the particle stream containing the ions to be analyzed passes through the ion flow guide, the ions are deflected based on their mass-to-charge ratio towards a detector, which detects the ions based on their charge or momentum.

Ideally, only the ions to be analyzed reach the detector. It is often the case, however, that elements not of interest reach the detector resulting in various false signals. Additionally, the presence of elements in addition to the ions to be analyzed within a particle stream introduced into a mass analyzer may lead to fouling of the mass analyzer and/or other complications affecting the accuracy of the mass spectrometer.

For example, the particle stream introduced to the mass analyzer often undesirably contains photons. The presence of photons within the particle stream may lead to the detection of false signals and/or otherwise create noise within the detector. In addition, the openings of some multipole ion guides may be narrow and prone to contamination by the entering particle stream thereby causing instrument drift.

SUMMARY

Various aspects, features and embodiments are described herein that comprise DC multipoles that are effective to direct ions along a desired or selected trajectory. Where two or more multipoles are present, the multipoles may be fluidically coupled so that ions can be provided from one multipole to another multipole.

In one aspect, device comprising a first multipole comprising a plurality of electrodes configured to provide a DC electric field effective to direct first ions of an entering particle beam along a first exit trajectory that is substantially orthogonal to an entry trajectory of the particle beam, and a second multipole fluidically coupled to the first multipole to receive the directed first ions from the first multipole along the first exit trajectory of the first multipole, the second multipole comprising a plurality of electrodes configured to provide a DC electric field effective to direct the received first ions from the first multipole along a second exit trajectory that is substantially orthogonal to the first exit trajectory is described.

In certain embodiments, the plurality of electrodes of the first multipole and the second multipole each are configured to provide the DC electric field using a direct current voltage applied to each electrode of the first multipole and the second multipole to provide the DC electric field from each of the first multiple and the second multipole. In other configurations, the DC electric field of the second multipole is configured to direct the received first ions along the second exit trajectory in a direction that is substantially parallel to a direction of the entry trajectory. In some instances, the DC electric field of the second multipole is configured to direct the received first ions along the second exit trajectory in a direction that is substantially antiparallel to a direction of the entry trajectory. In other configurations, the DC electric field of the second multipole is configured to direct the received first ions along the second exit trajectory in a direction that is substantially parallel to a direction of the entry trajectory in a first state and is configured to direct the received first ions along the second exit trajectory in a direction that is substantially antiparallel to a direction of the entry trajectory in a second state.

In some embodiments, the device may comprise at least one electrode positioned at an exit aperture of the first multipole. For example, the device may comprise a set of electrodes positioned at an exit aperture of the first multipole. In other configurations, the device may comprise at least one electrode positioned at an exit aperture of the second multipole, e.g., may comprise a set of electrodes positioned at an exit aperture of the second multipole. In some instances, the device may comprise a first set of electrodes positioned at an entry aperture of the first multipole, a second set of electrodes positioned at an exit aperture of the first multipole, a third set of electrodes positioned at an entry aperture of the second multipole and a fourth set of electrodes positioned at an exit aperture of the second multipole.

In certain configurations, the device may comprise a lens adjacent to the exit aperture of the second multipole, the lens configured to decrease an ion beam size exiting the exit aperture of the second multipole.

In some examples, each of the first multipole and the second multipole are independently configured as a DC quadrupole, a DC hexapole or a DC octupole. For example, both multipoles may be DC quadrupoles, or one multipole may be a DC quadrupole and the other multipole may be a multipole other than a DC quadrupole.

In some arrangements, the device may comprise a third multipole fluidically coupled to the second multipole to receive directed first ions from the second multipole along the second exit trajectory of the second multipole, the third multipole comprising a plurality of electrodes configured to provide a DC electric field effective to direct the received first ions from the second multipole along a third exit trajectory that is substantially orthogonal to the second exit trajectory. In some instances, the DC electric field of the third multipole is configured to guide the received first ions exiting along the third exit trajectory in a direction that is substantially antiparallel to a direction of the entry trajectory. In some configurations, the DC electric field of the third multipole is configured to guide the received first ions exiting along the third exit trajectory in a direction that is substantially parallel to the direction of the entry trajectory. In other configurations, at least one electrode is positioned at an exit aperture of the third multipole, e.g., a set of electrodes can be positioned at an exit aperture of the third multipole.

In some embodiments, the electrodes of the first multipole each comprise an inward facing curved surface. In other configurations, the electrodes of each of the first multipole and the second comprise an inward facing curved surface.

In some instances, the first multipole is configured to direct second ions of the introduced particle beam in a fourth trajectory, in which the fourth trajectory is substantially orthogonal to the first trajectory and in which the second ions are of opposite charge than the first ions.

In another aspect, a device comprising a first DC quadrupole comprising an entry aperture and an exit aperture substantially orthogonal to the entry aperture, the first DC quadrupole configured to deflect first ions of an entering particle beam to the exit aperture of the first DC quadrupole, and a second DC quadrupole comprising an exit aperture and an entry aperture fluidically coupled to the exit aperture of the first DC quadrupole, in which the entry aperture of the second DC quadrupole is substantially orthogonal to the exit aperture of the second DC quadrupole, in which the second DC quadrupole is configured to deflect first ions received at the entry aperture of the second DC quadrupole to the exit aperture of the second DC quadrupole is provided.

In certain configurations, the second DC quadrupole deflects the first ions to the exit aperture of the second DC quadrupole in a direction that is substantially parallel to a direction the first ions enter the entry aperture of the first DC quadrupole. In other configurations, the second DC quadrupole deflects the first ions to the exit aperture of the second DC quadrupole in a direction that is substantially antiparallel to a direction the first ions enter the entry aperture of the first DC quadrupole. In additional configurations, the first DC quadrupole comprises an additional exit aperture orthogonal to the entry aperture, in which the first DC quadrupole is configured to deflect second ions of the particle beam entering the entry aperture to the additional exit aperture of the first DC quadrupole.

In some instances, the device may comprise a third DC quadrupole comprising an exit aperture and an entry aperture fluidically coupled to the exit aperture of the second DC quadrupole, in which the entry aperture of the third DC quadrupole is substantially orthogonal to the exit aperture of the third DC quadrupole, in which the third DC quadrupole is configured to deflect first ions received at the entry aperture of the third DC quadrupole to the exit aperture of the third DC quadrupole.

In other instances, the device may comprise at least one lens adjacent to the exit aperture of the second DC quadrupole, the lens configured to decrease an ion beam size exiting the exit aperture of the second DC quadrupole.

In certain configurations, the device may comprise a third DC quadrupole comprising an exit aperture and an entry aperture fluidically coupled to the additional exit aperture of the first DC quadrupole, in which the entry aperture of the third DC quadrupole is substantially orthogonal to the exit aperture of the third DC quadrupole, in which the third DC quadrupole is configured to deflect second ions received at the entry aperture of the third DC quadrupole to the exit aperture of the third DC quadrupole. In some instances, the device may comprise a lens adjacent to the exit aperture of the third DC quadrupole, the lens configured to decrease an ion beam size exiting the exit aperture of the third DC quadrupole.

In certain examples, the device may comprise a set of electrodes adjacent to the entry aperture of the first DC quadrupole, adjacent to the entry aperture of the second DC quadrupole or both.

In another aspect, a device for guiding ions may comprise a first multipole comprising a first plurality of electrodes, said first multipole having a first opening and a second opening, said first plurality of electrodes configured such that application of one or more direct current (DC) voltages to said first plurality of electrodes provides a first DC electric field, wherein the first DC electric field is sufficient to cause first ions entering the first multipole via said first opening along a first trajectory to exit said first multipole via said second opening of said first multipole along a second trajectory, and wherein the second trajectory is substantially orthogonal to the first trajectory. The device may also comprise a second multipole comprising a second plurality of electrodes, said second multipole having a first opening and a second opening, wherein said first opening of said second multipole is in registration with said second opening of said first multipole, said second plurality of electrodes configured such that application of one or more DC voltages to said second plurality of electrodes provided a second DC electric field, wherein the second DC electric field is sufficient to cause first ions entering the second multipole via said first opening of said second multipole to exit the second multipole via said second opening of said second multipole along a third trajectory, and wherein the third trajectory is substantially orthogonal to the second trajectory.

In certain embodiments, the third trajectory is substantially parallel to the first trajectory, or the third trajectory is opposite in direction to the first trajectory.

In some configurations, each electrode of the first plurality of electrodes comprises an inward facing curved surface. In other configurations, the first multipole comprises a third opening, wherein the first DC electric field is sufficient to cause second ions entering the first multipole via said first opening along the first trajectory to exit said first multipole via said third opening along a fourth trajectory, and wherein the fourth trajectory is substantially orthogonal to the first trajectory and different from the second trajectory. In such configurations, the device may comprise a third multipole comprising a third plurality of electrodes; said third multipole having a first opening and a second opening, wherein said first opening of said third multipole is in registration with said third opening of said first multipole, said third plurality of electrodes configured such that application of one or more DC voltages to said third plurality of electrodes generates a third DC electric field, wherein the third DC electric field is sufficient to cause second ions entering the third multipole via said first opening of said third multipole along the fourth trajectory from said first multipole to exit said third multipole via said second opening of said third multipole along an exit trajectory; wherein the exit trajectory is substantially orthogonal to the fourth trajectory, and wherein the first ions are opposite in charge to the second ions.

In certain instances, the exit trajectory is substantially the same as the third trajectory or is substantially the same as the first trajectory.

In some configurations, each of the first plurality of electrodes comprises one or more outwardly facing surfaces. The device may also comprise a first plurality of plate electrodes flanking each of the one or more outwardly facing surfaces of the first plurality of electrodes. In some instances, each of the second plurality of electrodes comprises one or more outwardly facing surfaces, and the device further comprises a second plurality of plate electrodes flanking each of the one or more outwardly facing surfaces of the second plurality of electrodes.

In certain examples, the device may comprise a lens comprised of one or more electrodes defining, at least in part, a first aperture, wherein said first aperture is in registration with said second opening of said second multipole, and wherein application of one or more DC voltages to said one or more electrodes causes a reduction in a diameter of a stream of ions exiting said second opening of said second multipole.

In another aspect, a device, comprising a first DC quadrupole having a first opening and a second opening, said first DC quadrupole configured to cause first ions received via said first opening along a first trajectory to exit said first DC quadrupole via said second opening of said first DC quadrupole along a second trajectory, and wherein the first trajectory is substantially orthogonal to the second trajectory is provided. In some embodiments, the device may comprise a second DC quadrupole having a first opening and a second opening, wherein said first opening of said second DC quadrupole is positioned to receive ions exiting from said second opening of said first DC quadrupole, said second DC quadrupole configured to cause first ions received along the second first trajectory via said first opening of said second DC quadrupole to exit said second opening of said second DC quadrupole along a third trajectory, and wherein the second trajectory is substantially orthogonal to the third trajectory.

In some configurations, the first DC quadrupole further comprises a third opening; said first DC quadrupole configured to cause second ions received via said first opening of said first DC quadrupole along the first trajectory to exit said third opening of said first DC quadrupole along a fourth trajectory, and wherein the first trajectory is substantially orthogonal to the fourth trajectory. The device may further comprise a third DC quadrupole having a first opening and a second opening, wherein said first opening of said third DC quadrupole is positioned to receive ions exiting from said third opening of said first quadrupole, said third DC quadrupole configured to cause second ions received along the fourth first trajectory via said first opening of said third DC quadrupole to exit said second opening of said third DC quadrupole along an exit trajectory, wherein the exit trajectory is substantially orthogonal to the fourth trajectory, and wherein the first ions are opposite in charge to the second ions.

In certain instances, the exit trajectory is in substantially the same direction as the third trajectory or is in substantially the same direction as the first trajectory. In other instances, the third trajectory is substantially parallel to the first trajectory, or the third trajectory is opposite in direction to the first trajectory.

In an additional aspect, a method comprising deflecting ions of a particle beam that enter a first multipole along an exit trajectory, in which the exit trajectory is substantially orthogonal to an entry trajectory of the particle beam, and deflecting ions along the exit trajectory using a second multipole fluidically coupled to the first multipole, in which the second multipole is configured to deflect the exit trajectory ions along a third trajectory that is substantially orthogonal to the exit trajectory is disclosed.

In certain instances, the method may comprise configuring each of the first multipole and the second multipole with a DC electric field to deflect the ions. In other instances, the method may comprise configuring the second multipole to deflect the ions along the third trajectory in a direction that is substantially antiparallel to a direction of the entry trajectory. In some configurations, the second multipole can be configured to deflect the ions along the third trajectory in a direction that is substantially parallel to a direction of the entry trajectory. If desired, the method can include focusing ions exiting along the third trajectory using at least one lens. In other instances, ions entering the entry aperture of the first multipole using a set of electrodes can be focused. In some embodiments, the method may comprise deflecting ions along the third trajectory of the second multipole using a third multipole fluidically coupled to the second multipole, in which the third multipole is configured to deflect the third trajectory ions along a fourth trajectory that is substantially orthogonal to the third trajectory.

In some configurations, the method ma comprise deflecting second ions of the particle beam that enter the first multipole along an additional exit trajectory, in which the additional exit trajectory is substantially orthogonal to an entry trajectory of the particle beam, and in which the second ions of the particle beam are of opposite charge to the ions of the particle beam.

In some instances, a lens may be present and adjacent to an exit aperture where the second ions along the additional exit trajectory exit to focus ions. If desired, the ions can be deflected along the exit trajectory using at least one flanking electrode.

In another aspect, a method of guiding the flow ions of a particle stream, comprising introducing the particle stream containing the ions into a first DC electric field along a first trajectory, deflecting first ions of the stream with the first DC electric field along a second trajectory, and wherein the second trajectory is substantially orthogonal to the first trajectory is described. The method may also include receiving the deflected first ions into a second DC electric field along the second trajectory, and deflecting the first ions received into the second DC electric field along a third trajectory, and wherein the third trajectory is substantially orthogonal to the second trajectory.

In some instances, the third trajectory is opposite in direction to the first trajectory.

In certain configurations, the method may comprise deflecting second ions of the stream with the first DC electric field along a fourth trajectory, wherein the fourth trajectory is substantially orthogonal to the first trajectory, receiving the deflected second ions into a third DC electric field along the fourth trajectory, deflecting the second ions received into the third DC electric field along an exit trajectory, wherein the exit trajectory is substantially orthogonal to the fourth trajectory, and wherein the first ions are opposite in charge to the second ions. In some instances, the exit trajectory is in substantially the same direction as the third trajectory. In other instances, the exit trajectory is in substantially the same direction as the first trajectory. In some configurations, the third trajectory is parallel to the first trajectory.

In some embodiments, the method may also include focusing first ions exiting the second quadrupole field through an aperture defined, at least in part, by one or more electrodes.

BRIEF DESCRIPTION OF THE DRAWINGS

Certain features, attributes, configurations and aspects are further described in the detailed description that follows, by reference to the appended drawings by way of non-limiting illustrative embodiments, in which like reference numerals represent similar parts throughout the drawings. As should be understood, however, the devices and methods described herein are not limited to the precise arrangements and instrumentalities depicted in the drawings. In the drawings.

Unless otherwise stated herein, no particular sizes, dimensions or geometry is intended to be required for the apertures, electrodes or other structural components of the devices described herein.

DETAILED DESCRIPTION

In the following description, for purposes of explanation and not limitation, specific details are set forth, such as particular electrodes, DC fields, ion trajectory paths, etc. are described in order to illustrate the devices and methods. However, it will be apparent to one skilled in the art, given the benefit of this disclosure, that the devices and methods may be practiced in other embodiments that depart from these specific details. Detailed descriptions of well-known signals, circuits, thresholds, components, particles, particle streams, operation modes, techniques, protocols, and hardware arrangements, either internal or external, electrodes, frequencies, etc., are omitted so as not to obscure the description. In certain embodiments, the DC fields described herein may be considered static fields in that the applied voltages generally do not change, e.g., are substantially constant, during guidance of the ions entering into and/or exiting the devices.

In certain configurations, the methods and devices described herein are effective to direct ions along a desired path. In addition to other applications, the example embodiment of the depicted in FIG. 1 may be utilized with a mass spectrometer prior to sample introduction into a reaction cell, collision cell and/or mass analyzer to separate ions of interest from other elements that may coexist within a particle stream provided by the ion source. Describing the depicted embodiment depicted in FIG. 1 with reference to use in a mass spectrometer is intended only to assist in explaining the operation of that embodiment.

Figure 1:
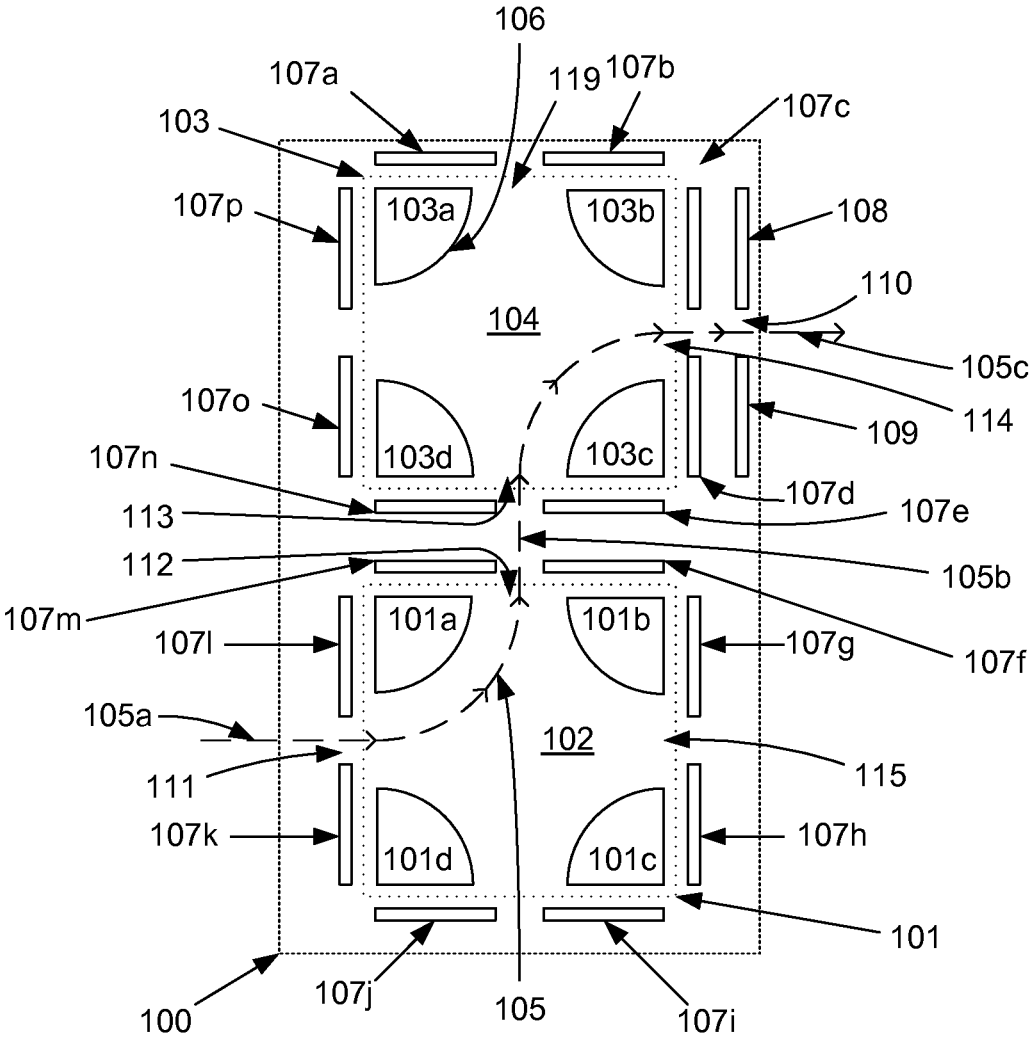
FIG. 1 is a schematic view of one embodiment of an ion flow guide according to one configuration.

The example embodiment of an ion flow guide 100 depicted in FIG. 1 includes a first direct current (DC) quadrupole 101 and a second DC quadrupole 103 that cooperate to deflect ions within a particle stream twice, orthogonally along a path generally indicated in FIG. 1 by path 105. As noted below, a DC quadrupole may be provided by applying a direct current voltage to a plurality of electrodes. For example, a direct current voltage may be applied in the absence of any radio frequencies. In some instances, only the direct current voltage is applied, e.g., no radio frequency signal or energy is provided to the electrodes used to provide the DC field. The particle stream is introduced along a first trajectory 105*a* into the first quadrupole 101 of the ion flow guide 100 at aperture 111 (between electrodes of 101*a* and 101*d*). As the particle stream enters into common space 102 the electrostatic field provided by the first quadrupole 101 directs or deflects ions of a particular charge along a second trajectory 105*b* that is substantially orthogonal (substantially 90 degrees in relation) to the trajectory 105*a*. The deflected ions exit the first DC quadrupole 101 through an aperture 112 (between electrodes 101*a* and 101*b*) along a trajectory 105*b* and enter the second DC quadrupole 103 via aperture 113 (between electrodes 103*c* and 103*d*). As the ions pass through the electrostatic field provided by the second quadrupole 103 they are deflected a second time along a third trajectory 105*c* that is substantially orthogonal to the trajectory 105*b*. The ions then exit the second DC quadrupole 103 via aperture 114 (between electrodes 103*b* and 103*c*). Thus, ions exit the first DC quadrupole 101 along a trajectory (105*b*) that is substantially orthogonal to the trajectory along which the particle stream enters the first DC quadrupole 101 (105*a*). Similarly, the ions exit the second DC quadrupole 103 along a trajectory (105*c*) that is substantially orthogonal to the trajectory along which deflected ions enter the second DC quadrupole 103 (105*b*). In this embodiment, "substantially orthogonal" is meant to comprise within two degrees of orthogonal (e.g., eighty-eight to ninety-two degrees), while in some embodiments it may comprise within three degrees of orthogonal, within five degrees of orthogonal, or within ten degrees of orthogonal.

In certain instances, a first DC quadrupole electric field is provided by applying a DC voltage to the plurality of electrodes 101*a*, 101*b*, 101*c*, and 101*d* of quadrupole 101, which are set about a common space 102 to deflect ions substantially orthogonally. Similarly, a second DC field is provided by applying a DC voltage to the plurality of electrodes 103*a*, 103*b*, 103*c*, and 103*d* of quadrupole 103, which are set about a second common space 104 to deflect ions substantially orthogonally. Ions of this embodiment are deflected orthogonally by the second field along a trajectory (105*c*) that is parallel to the trajectory of the ions entering the first field (105*a*). Accordingly, as ions pass through the fields provided by quadrupoles 101 and 103, the ions are directed along a path 105 illustrated in FIG. 1. In addition to other applications, the double orthogonal deflection of the ions along path 105 may separate ions of interest from other elements (e.g. photons) that may coexist within the particle stream.

It should be noted that paths depicted in the drawings represent approximations and the actual paths taken by any ion deflected may vary based on numerous factors such as, for example, the strength of the electric field. Nonetheless, the depicted paths provide a useful tool for discussion concerning the operation of certain embodiments. The path that the ions are directed along by the DC electric fields provided by quadrupoles 101 and 103 may vary depending upon the intended application of the ion flow guide. In addition to other applications, path 105 depicted in FIG. 1 may have utility for separating ions to be analyzed from photons, neutrals, oppositely charged ions and/or other additional elements that may be present within the particle stream. As a particle stream provided from the ion source passes through aperture 111 into common space 102, the DC quadrupole electric field provided by applying DC voltages to the electrodes of quadrupole 101 will deflect or direct ions within the stream about electrode 101*a* toward the second quadrupole 103. The deflected ions will thus exit the first DC quadrupole 101 via aperture 112. Photons and neutrals, however, within the particle stream may be unaffected by the field provided by DC quadrupole 101 and may exit the common space 102 of DC quadrupole 101 via aperture 115. The deflection of ions passing through common space 102 by the DC quadrupole field provided by DC quadrupole 101 may thus separate ions to be detected from neutrals, photons and/or other elements within the particle stream.

Some of the undesired elements within the particle stream may remain in the stream and not exit first quadrupole 101 via aperture 115. More specifically, a portion of the undesired elements within the particle stream may diffuse, scatter, and/or otherwise follow the ions to be analyzed into the second DC quadrupole 103. Deflecting the particle stream a second time as they pass through the DC quadrupole field provided by the second DC quadrupole 103, along trajectory 105*c* (which is substantially orthogonal to trajectory 105*b*), may further reduce the number the undesired elements that enter the detector (not shown). More specifically, while the deflected ions will exit the second DC quadrupole 103 via aperture 114, photons and neutral within the particle stream may be unaffected by the field provided by the second DC quadrupole 103 and may exit the common space 104 of the DC quadrupole 103 via aperture 119.

Accordingly, the example embodiment depicted in FIG. 1 may separate photons, neutrals and/or other undesirable elements from the particle stream and deflect the ions of interest towards a mass analyzer, reaction cell, collision cell, detector or other component.

In certain examples, ions are influenced to travel along path 105 by being deflected within common space 102 by the DC quadrupole field provided by the DC quadrupole 101 and by being deflected a second time within common space 104 by the DC quadrupole field provided by the DC quadrupole 103. To generate a DC quadrupole field sufficient to deflect ions within common space 102 along path 105 of the embodiment shown in FIG. 1, direct current (DC) voltage may be applied to each of the electrodes 101*a*, 101*b*, 101*c* and 101*d*. If the ions to be deflected are cations and such ions are to follow path 105, then the voltages applied to electrodes 101*a* and 101*c* may be more negative than the voltages applied to electrodes 101*b* and 101*d*. For example, if path 105 represents a path taken by cations having a mass of 40-90 amu the voltages applied to electrodes 101*a* and 101*c* may be between −60 Volts to −120 Volts, e.g., −100 Volts, and the voltages applied to electrodes 101*b* and 101*d* may be +40 Volts to −40 Volts, e.g., −12 Volts. The second DC quadrupole field provided by DC quadrupole 103 deflecting cations within common space 104 along path 105 may likewise be provided by applying more negative DC voltages to electrodes 103*a* and 103*c* than to electrodes 103*b* and 103*d*. For example, the voltages applied to electrodes 103*a* and 103*c* may be −60 Volts to −120 Volts, e.g., −100 Volts and the voltages applied to electrodes 103*b* and 103*d* may be +40 Volts to −40 Volts, e.g., −12 Volts. The particular voltages may be selected based on the ions of interest, the size, shape and spacing of the electrodes and various other factors. In addition, the voltages applied may not be symmetrical in all configurations. For example, the use of DC voltages to provide DC quadrupole fields may permit some embodiments to have wider apertures between the electrodes (e.g., apertures 111 and 114) than would otherwise be permitted. The larger apertures may reduce the likelihood of contamination, which could lead to a reduction in instrument drift.

In the example embodiment shown in FIG. 1, the electrodes of DC quadrupoles 101 and 103 have inward facing curved surfaces 106 and a configuration corresponding to a quarter of a cylinder as depicted in FIG. 1. In some embodiments, the inward facing curved surfaces 106 may aid in deflecting ions along desired orthogonal trajectories. Depending on the desired path, electrodes having other configurations (e.g., other surfaces, shapes, etc.) may be utilized in combination with or in the alternative to curved surfaces. For example, all or a portion of the electrodes may have inward facing surfaces with a hyperbolic curvature. All or a portion of the electrodes, alternatively, may have inward facing flat surfaces set at appropriate angles to achieve deflection along the desired path.

The embodiment of FIG. 1 also can include flanking electrodes 107*a-p* which comprise plates (though other configurations may be equally as effective) to which a DC voltage may be applied. Flanking the outside surfaces of the DC quadrupoles may increase the adherence of deflected ions to the desired path as they pass through the common space between the electrodes of the quadrupole. The potential applied to an electrode flanking the outside surfaces of an electrode around which ions are to be deflected may be higher than that of the electrodes if cations are to be deflected and may be lower than that of the electrodes if anions are to be deflected. For example, if the embodiment depicted in FIG. 1 were to be utilized to deflect cations having a mass of 40-90 amu along path 105 the electrodes 1071 and 107*m* flanking electrode 101*a* may have potentials of −50 Volts to 0 Volts, e.g., electrode 1071 and electrode 107*m* may have potentials of −35 V and −10 V, respectively. In some instances, the electrodes 107*d* and 107*e* flanking electrode 103*c* may have potentials of −50 Volts to 0 Volts, e.g., −10 Volts. Other voltages, of course, may be equally as effective.

In certain configurations, deflected ions exiting a DC quadrupole may be focused along a path by providing a "lens" through which deflected ions pass. The lens may be an electrode or set of electrodes providing an aperture through which exiting ions traverse. The embodiment depicted in FIG. 1, for example, includes a lens comprised of two plate electrodes 108 and 109 providing aperture 110 and positioned to focus ions exiting common space 104 through aperture 110 when a suitable potential is applied to the electrodes 108 and 109. For example, if the embodiment depicted in FIG. 1 is used to deflect cations having a mass of 40-90 amu along path 105, a DC potential of −10 V may be applied to plates 108 and 109. Aperture 110 also may be smaller (e.g., have a smaller diameter) than the opening 114 of the second quadrupole 103. Other voltages, of course, may be equally as effective.

Figure 2:
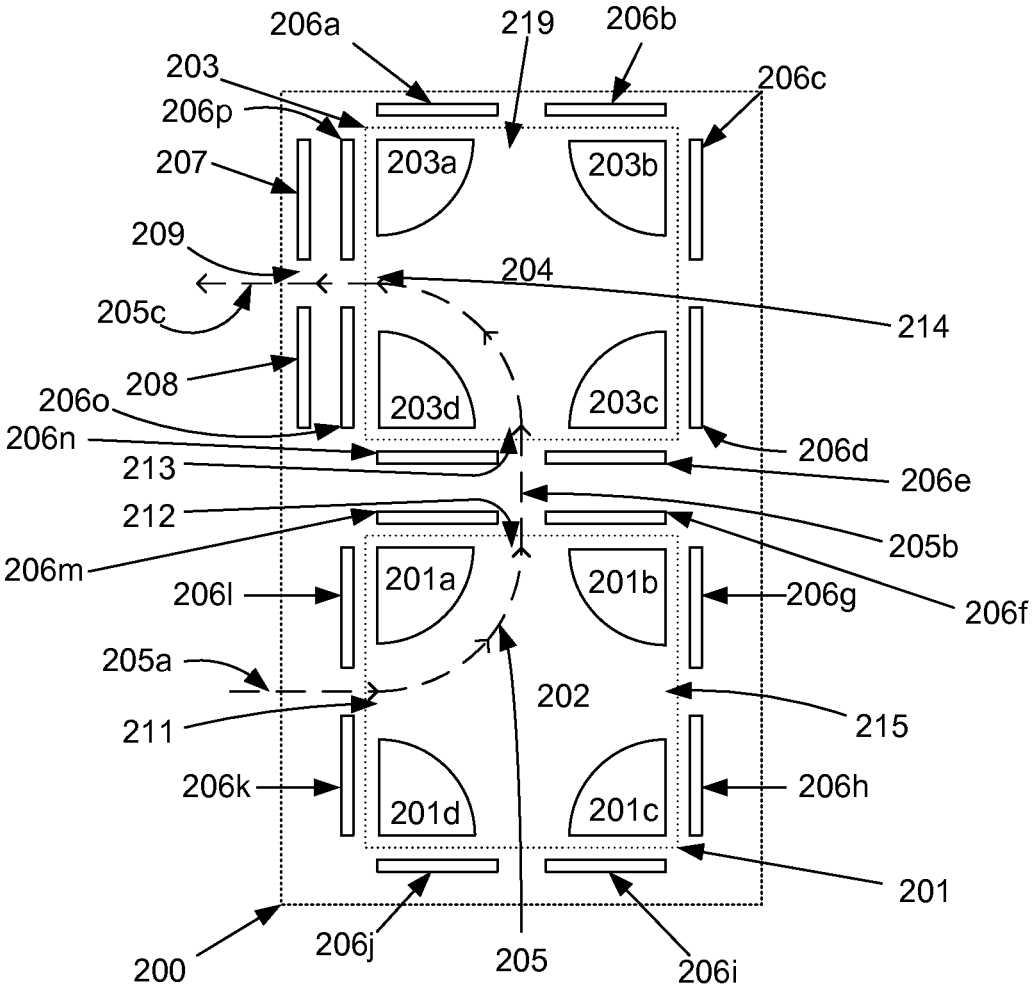
FIG. 2 is a schematic view of an embodiment of an ion flow guide according to another configuration.

In certain configurations, while the embodiment depicted in FIG. 1 deflects ions twice orthogonally in which ions exit along a trajectory 105*c* that is parallel to the trajectory 105*a* at which ions enter the first quadrupole 101, other embodiments may direct ions along other paths. The embodiment depicted in FIG. 2, for example, deflects ions twice orthogonally and the exit path 205*c* of the ions is opposite (and parallel) to the trajectory 205*a* of ions entering the first DC quadrupole 201. The example embodiment depicted in FIG. 2 is configured to direct the flow of ions along a path generally indicated in FIG. 2 by dashed line 205. A first DC quadrupole electric field is provided by applying a DC voltage to a plurality of electrodes 201*a*, 201*b*, 201*c*, and 201*d* of a first DC quadrupole 201. A second DC field is provided by applying a DC voltage to plurality of electrodes 203*a*, 203*b*, 203*c*, and 203*d* of a second DC quadrupole 203. As ions pass through the electric fields provided by DC quadrupoles 201 and 203 they are deflected along a path approximated by dashed line 205 of FIG. 2. The double orthogonal deflection along path 205 may separate ions of interest from other elements in the particle stream. The particle stream containing ions is introduced along a first trajectory 205*a* into the ion flow guide 200 via aperture 211 between electrodes 201*a* and 201*d* of the first DC quadrupole 201. As the particle stream passes into common space 202, the electrostatic field provided by the DC quadrupole 201 deflects the ions of interest along a second trajectory 205*b* (that is substantially orthogonal to the trajectory 205*a* at which the stream enters DC quadrupole 201). The deflected ions exit the first DC quadrupole 201 through aperture 212 between electrodes 201*a* and 201*b* along trajectory 205*b* and enter the second DC quadrupole 203 via aperture 213. As the ions pass through the electrostatic field provided by the second DC quadrupole 203 they are deflected a second time along a third trajectory 205*c* (that is substantially orthogonal to the trajectory 205*b* at which the deflected ions enter second DC quadrupole 203), and exit the second DC quadrupole 203 via aperture 214 between electrodes 203*a* and 203*d*.

In some instances, the embodiment depicted in FIG. 2 may be employed to separate ions from other undesired elements within a particle stream. Specifically, as the particle stream enters common space 202, the field provided by the electrodes of DC quadrupole 201 will deflect ions of interest within the stream about electrode 201*a*, along trajectory 205*b* (substantially orthogonal to trajectory 205*a* at which the ions enter common space 202 and DC quadrupole 201). The deflected ions will thus exit DC quadrupole 201 via aperture 212. Photons, neutrals and other particles within the stream lacking a sufficient charge to be deflected about electrode 201*a*, however, may exit quadrupole 201 via aperture 215 between electrodes 201*b* and 201*c* and/or elsewhere. Similarly, as the particle stream enters common space 204 of the second DC quadrupole 203, the field provided by the electrodes of DC quadrupole 203 will deflect ions of interest within the stream about electrode 203*d*, along trajectory 205*c* (substantially orthogonal to trajectory 205*b* along which the ions enter common space 204 and DC quadrupole 203). The deflected ions will thus exit DC quadrupole 203 via aperture 214. Photons, neutrals and other particles within the stream lacking a sufficient charge to be deflected about electrode 203*d*, however, may exit the second DC quadrupole 203 via aperture 219 between electrodes 203*a* and 203*b* and/or elsewhere. The deflection of ions passing through the common spaces 202 and 204 by the DC quadrupole fields provided by DC quadrupoles 201 and 203, respectively, may thus separate ions of interest from neutrals, photons and/or other undesirable elements within the particle stream. It is worth noting that trajectory of the particle stream entering the ion flow guide 200 is substantially parallel and in opposite direction, e.g., anti-parallel, to the path of ions exiting the guide 200. This configuration may permit compact configurations and/or be otherwise desirable.

In certain instances, to generate a DC quadrupole field sufficient to deflect ions within common space 202 along path 205 of the embodiment shown in FIG. 2, DC voltages may be applied to the electrodes 201*a*, 201*b*, 201*c* and 201*d*. If path 205 represents that of cations, the voltages applied to electrodes 201*a* and 201*c* may be more negative than that the voltage applied to electrodes 201*b* and 201*d*. For example, if the path 205 represents that taken by cations having a mass of 40-90 amu the DC voltage applied to electrodes 201*a* and 201*c* may be −100 V and the DC voltages applied to electrodes 201*b* and 201*d* may be −50 Volts to about 0 Volts, e.g., about −10 Volts. The second DC quadrupole field provided by the DC quadrupole 203 deflecting cations within common space 204 along path 205 may likewise be provided by applying DC voltages to electrodes 203*a*, 203*c*, 203*b* and 203*d* such that the voltage potential of electrodes 203*a* and 203*c* is more positive than that of electrodes 203*b* and 203*d*. Other voltages, of course, may be equally as effective and the voltages need not be symmetrical.

In certain embodiments, the configuration shown in FIG. 2 also comprises flanking electrodes 206*a-p* which comprise plates (though other configurations may be equally as effective) to which a DC voltage may be applied. Flanking the outside surfaces of the DC quadrupoles may increase the adherence of deflected ions to the desired path as they pass through the common space between the electrodes of the DC quadrupole. The potentials applied to the flanking electrodes may vary depending on various factors including the ions to be deflected along path 205. For example, if the embodiment depicted in FIG. 2 were to be utilized to deflect cations having a mass of 40-90 amu along path 205 the electrodes 2061 and 206*m* flanking electrode 201*a* may have potentials of −40 V and −25 V, respectively, and electrodes 206*n* and 206*o* flanking electrode 203*d* may have potentials of −25 V and −40 V, respectively. The remaining flanking electrodes 206 may have potentials of −40 V. If desired, the potential of the various flanking electrodes may vary from about −80 Volts to about −5 Volts though other voltages may be equally as effective.

The embodiment of FIG. 2 also includes a lens comprised of two plate electrodes 208 and 207 providing an aperture 214 and positioned to focus deflected ions exiting common space 204 through aperture 214 when a suitable potential is applied to the electrodes 208 and 207. If the embodiment depicted in FIG. 2 were to be utilized, for example, to deflect cations having a mass of 40-90 amu along path 205 a DC potential of −5 V may be applied to electrodes 207 and 208 of the lens. Other voltages, of course, may be equally as effective. Additionally, the lens may comprise a single electrode having an aperture through which exiting deflected ions may be focused when an appropriate potential is applied to the lens.

In addition to deflecting ions along a single path, embodiments of the present invention also facilitate deflecting ions along multiple paths. The embodiment depicted in FIG. 3, for example, may be used to simultaneous deflect cations and anions along two separate paths. Specifically, the example embodiment depicted is configured to direct the flow of cations along a path generally indicated in FIG. 3 by dashed line 307 and is configured to direct the flow anions along a path generally indicated by dashed line 308. This embodiment includes a first DC quadrupole 301, disposed between a second DC quadrupole 303 and a third DC quadrupole 305. A first DC electric field is provided by applying one or more DC voltages to the electrodes 301*a*, 301*b*, 301*c*, and 301*d* forming the first DC quadrupole 301. A second DC electric field is provided by applying one or more DC voltages to the electrodes 303*a*, 303*b*, 303*c*, and 303*d* of the second DC quadrupole 303. A third DC electric field is provided by applying one or more DC voltage to the electrodes 305*a*, 305*b*, 305*c*, and 305*d* of the third DC quadrupole 305. The particle stream is introduced into the ion flow guide via an aperture 316 of the first DC quadrupole 301. As the particle stream enters the first DC quadrupole 301, the electric field directs cations along a path indicated by dashed line 307 toward (and through) a first aperture 317 of the first DC quadrupole and anions along a path indicated by dashed line 308 toward (and through) a second aperture 320 of the first DC quadrupole. Cations exiting the first DC quadrupole 301 via aperture 317 enter the second DC quadrupole 303 via aperture 318. The electric field provided by the second DC quadrupole 303 direct the cations out aperture 319 of the second DC quadrupole 303. The exiting ions are focused by the lens comprised of plates 310 and 311.

Anions exiting the first DC quadrupole 301 via aperture 320 enter the third DC quadrupole 305 via aperture 321. The electric field provided by the third DC quadrupole 305 direct the anions out aperture 322 of the third DC quadrupole 305. The exiting anions are focused by the lens comprised of plates 313 and 314.

Figure 3:
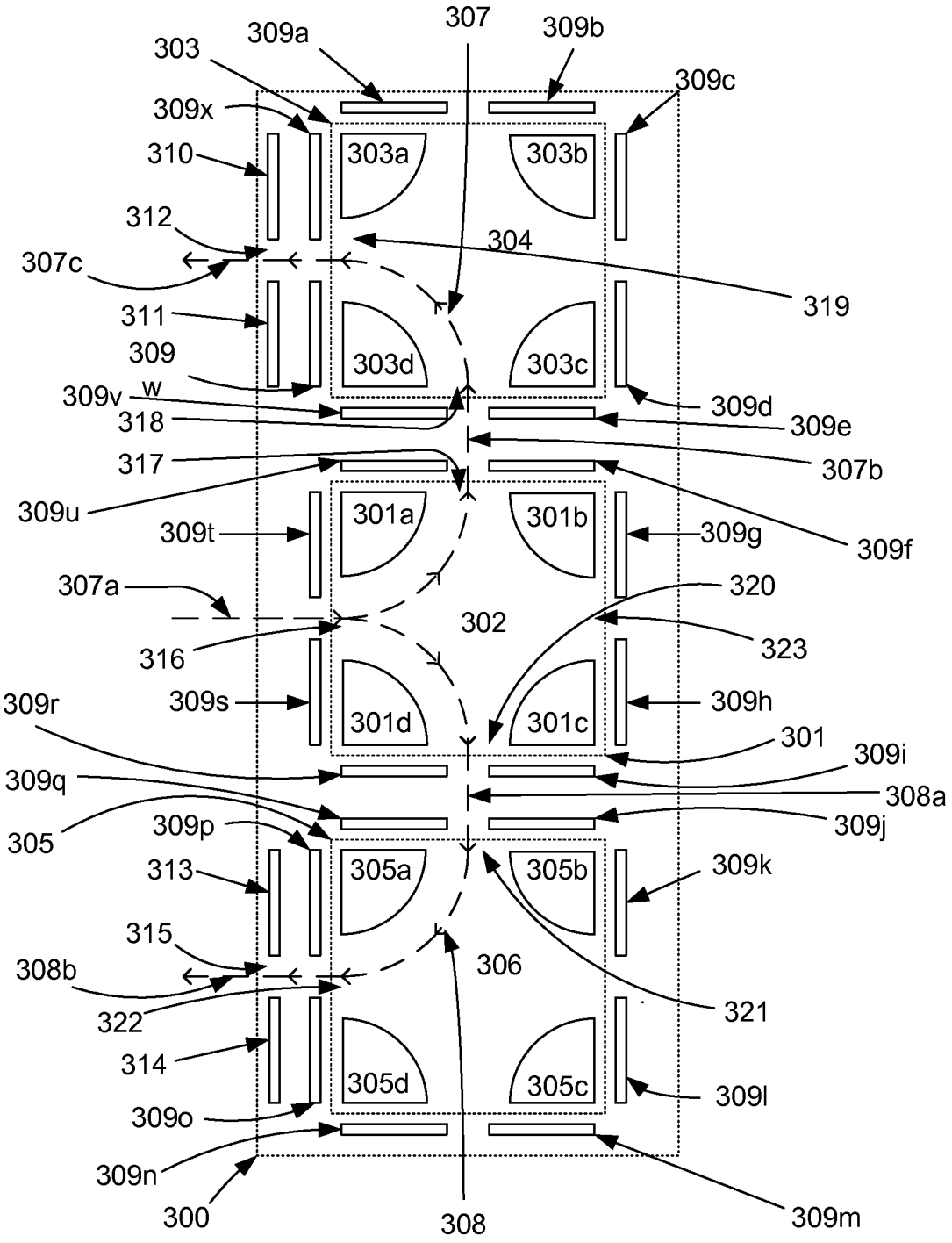
FIG. 3 is a schematic view of an embodiment of an ion flow guide according to yet another configuration.

The example embodiment depicted in FIG. 3 is effective to simultaneously deflect anions and cations along diverging paths. In addition to other applications, the simultaneous double orthogonal deflection of anions and cations along diverging paths 308 and 307 may separate anions and cations of interest from other elements that may coexist within a particle stream. The DC quadrupole field provided by the electrodes of DC quadrupole 301 will deflect cations within the stream about electrode 301*a*, along a trajectory 307*b* (which is substantially orthogonal to the trajectory 307*a* at which the particle stream enters the first DC quadrupole 301). Anions within the particle stream entering the DC quadrupole 301 likewise are deflected along a trajectory 308*a* (substantially orthogonal to the trajectory 307*a*). Photons, neutrals and/or other elements within the entering particle stream, lacking a sufficient charge to be deflected about electrodes 301*a* or 301*d*, may exit common space 302 through aperture 323 between electrodes 301*b* and 301*c*. The diverging deflection of cations and anions passing through common space 302 by the DC quadrupole field provided by DC quadrupole 301 may thus separate cations and anions from each other and from other elements within the particle stream.

A portion of the elements within the particle stream may diffuse, scatter, and/or otherwise follow the deflected cations and/or anions into common spaces 304 and/or 306. Deflecting the cations a second time about electrode 303*d* as they pass through the DC quadrupole field provided by DC quadrupole 303, towards trajectory 307*c* (which is substantially orthogonal to trajectory 307*b* at which the cations enter common space 304 and DC quadrupole 303) may further separate cations from other elements within the particle stream. Similarly, deflecting anions a second time about electrode 305*a* as they pass through the DC quadrupole provided by DC quadrupole 305, along trajectory 308*b* (which is substantially orthogonal to trajectory 308*a* at which the cations enter common space 306 and DC quadrupole 305) may further separate anions from other elements within the particle stream. The second deflection of cations and anions within common spaces 304 and 306 are along trajectories 307*c* and 308*b*, respectively, are opposite in direction to the trajectory 307*a* at which the particle stream enters common the first DC quadrupole 301 via aperture 316. Accordingly, if employed in or with a mass spectrometer the embodiment depicted in FIG. 3 may deflect anions and cations of interest (separately) while also separating them from photons, neutrals and/or other additional elements not of interest within a particle stream. Thus, this example embodiment may allow simultaneous dual analysis of anions and cations which may coexist within organic (and/or other) samples. A mass analyzer, detector or other component may be coupled to each of the exit apertures to receive either cations or anions exiting from the device.

In certain configurations, if path 307 represents the path of cations and path 308 represents a path of anions from a common particle stream entering the first DC quadrupole 301 via aperture 316 then the DC voltages applied to electrodes 301*a* and 301*c* may be more negative than the voltage applied to electrodes 301*b* and 301*d*. For example, the voltage applied to electrodes 301*a* and 301*c* may be −80 V and the voltage applied to electrodes 301*b* and 301*d* may be −15 V. The second quadrupole field provided by quadrupole 303 may likewise be provided by applying DC voltages to electrodes 303*a*, 303*b*, 303*c* and 303*d* such that the voltage applied to electrodes 303*a* and 303*c* is more positive than the voltage applied to electrodes 303*b* and 303*d*. For example, the voltage applied to electrodes 303*a* and 303*c* may be −18 V and the voltage applied to electrodes 303*b* and 303*d* may be −80 V. The third quadrupole field provided by quadrupole 305 may likewise be provided by applying DC voltages to electrodes 305*a*, 305*b*, 305*c* and 305*d* such that the voltage applied to electrodes 305*a* and 305*c* is more negative than the voltage applied to electrodes 305*b* and 305*d*. For example, the voltage applied to electrodes 305*a* and 305*c* may be −80 V and the voltage applied to electrodes 303*b* and 303*d* may be −2 V. Other voltages, of course, may be equally as effective and the voltages applied need not be symmetrical.

In certain instances, it may be desirable to flank the outside surfaces of the electrodes with an additional flanking electrode to which potentials are applied may increase the adherence of deflected ions to paths 307 and 308. As shown in the embodiment depicted in FIG. 3, the flanking electrodes 309*a-x* may comprise plates, although other configurations may be equally as effective. In the embodiment shown in FIG. 3, each electrode is flanked by a plate electrode 309*a-x*. The specific arrangement of plate electrodes 309 provides apertures in addition to those needed for deflected ions to along paths 307 and 308; thereby permitting elements not intended to be deflected to exit common space 302 without having to enter common spaces 304 and 306 or to exit via apertures 319 or 322. The provision of an additional aperture, accordingly, may limit the amount of unwanted elements following paths 307 and 308. The potentials applied to electrodes flanking the outside surfaces of electrodes 301*a*, 301*d*, 303*d* and 305*a* may vary depending upon the ions to be deflected along paths 307 and 308. For example, if the embodiment depicted in FIG. 3 were to be utilized to deflect cations and anions from a common stream along paths 307 and 308, respectively, the electrodes 309*t* and 309*u* flanking electrode 301*a* may have potentials of −40 V and −35 V, respectively, the electrodes 309*r* and 309*s* flanking electrode 301*d* may have potentials of −15 V and −40 V, respectively, the electrodes 309*v* and 309*w* flanking electrode 303*d* may have potentials of −35 V and −40 V, respectively, and the electrodes 309*p* and 309*q* flanking electrode 305*a* may have potentials of −40 V and −15 V, respectively. The remaining flanking electrodes 309 may have a potential of −40 V. Other voltages, of course, may be equally as effective.

As with the previously described embodiments, the embodiment depicted in FIG. 3 includes a lens comprised of two plate electrodes 310 and 311 providing an aperture 312 positioned to focus deflected cations exiting the second DC quadrupole 303 through aperture 319 when a suitable potential is applied to electrodes 310 and 311. For example, a potential of −25 V may be applied electrodes 310 and 311 of the lens. Other voltages, of course, may be equally as effective. Additionally, the lens may comprise an electrode having an aperture through which exiting deflected cations may be focused when an appropriate potential is applied to the lens. The embodiment depicted in FIG. 3 also contains a second lens comprised of two plate electrodes 313 and 314 providing an aperture 315 positioned to focus deflected anions exiting from the third DC quadrupole 305 through aperture 322 when a suitable potential is applied to electrodes 313 and 314. For example, a potential of −10 V may be applied to electrodes 313 and 314 of the lens. Other voltages, of course, may be equally as effective. Additionally, the lens may in combination or the alternative comprise an electrode having an aperture through which exiting deflected anions may be focused when an appropriate potential is applied to the lens.

While in the embodiment of FIG. 3 the ions exit the second and third quadrupoles 303 and 305 in a direction that is opposite to the direction that the particle stream enters the first quadrupole 301, in other embodiments either or both of the second and third DC quadrupoles 303 and 305 may be configured to deflect ions so that they exist in the same direction and parallel to the direction that the particle stream enters the first DC quadrupole 301. While the multipole embodiments described above employ four electrodes (and comprise quadrupoles), other embodiments may employ three, five, six, seven, or another number of electrodes. For example, DC hexapoles or DC octupoles may be used to direct ions within the device.

Certain specific examples are described below to illustrate further some of the novel attributes and aspects of the technology described herein.

Example 1

Figure 4:
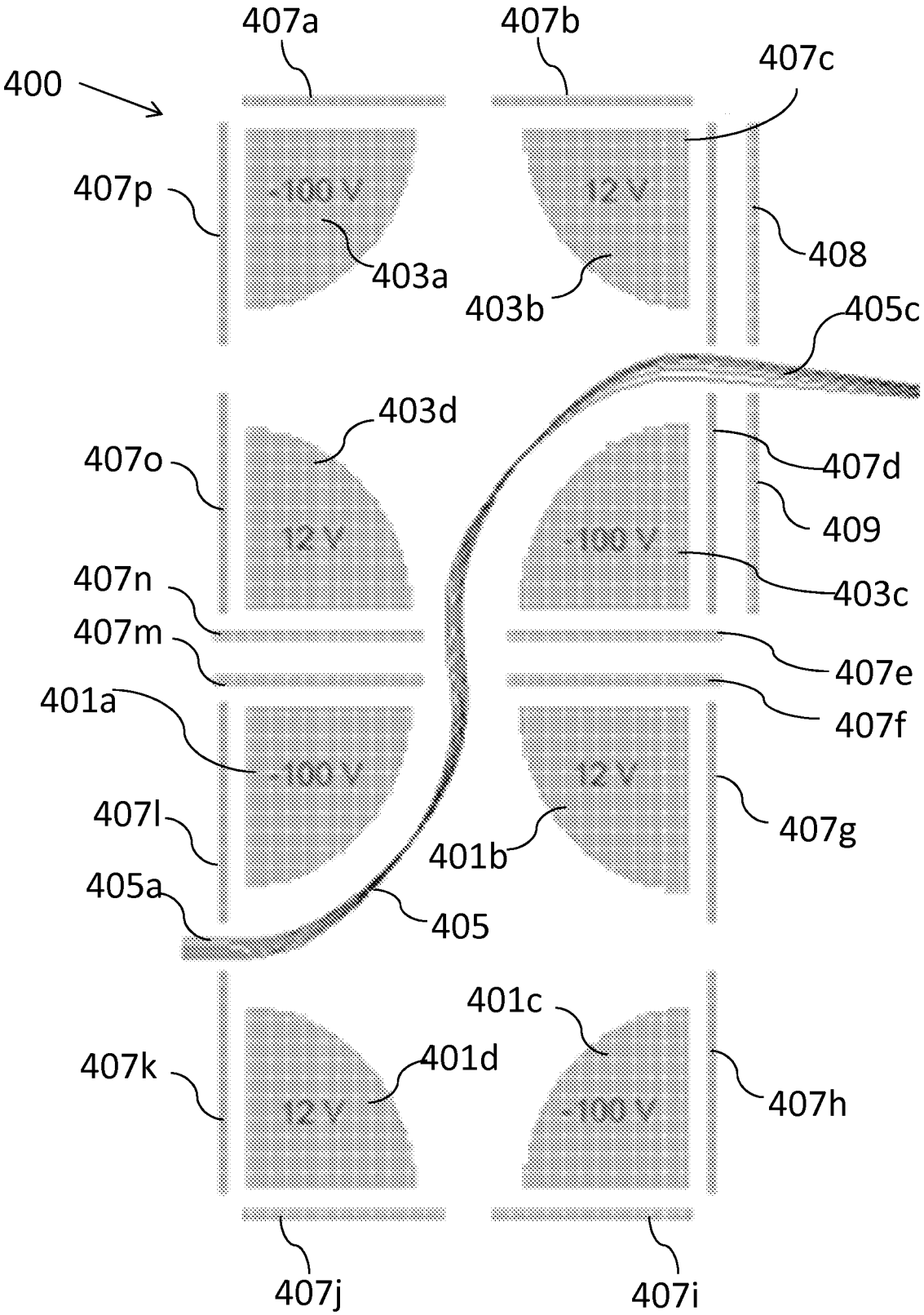
FIG. 4 is an illustration of an embodiment of an ion flow guide showing specific DC voltages applied to electrodes according to one configuration.

Referring to FIG. 4, a device 400 is shown comprising first electrodes 401*a*-401*d*, second electrodes 403*a*-403*d*, flanking electrodes 407*a*-407*p* and electrodes 408, 409, which together can function as a lens. A first DC quadrupole field is provided by applying a DC voltage to the plurality of electrodes 401*a*, 401*b*, 401*c*, and 401*d*. The voltages applied to electrodes 401*a* and 401*c* can be −100 Volts, and the voltages applied to electrodes 401*b* and 401*d* can be +12 Volts. A second DC quadrupole field is provided by applying a DC voltage to the plurality of electrodes 403*a*, 403*b*, 403*c*, and 403*d*. The DC voltages applied to electrodes 403*a* and 403*c* can be −100 Volts, and the DC voltages applied to electrodes 403*b* and 403*d* can be +12 Volts. As ions pass through the DC fields provided by the DC quadrupoles, the ions are deflected along a path approximated by the path 405 shown in FIG. 4. Electrodes 407*a*-407*p*, which comprise plate electrodes, may be used to provide a DC voltage. In the configuration shown in FIG. 4, to deflect cations with a mass of 40-90 atomic mass units (amu) along the path 405, the electrode 4071 may have a potential of −35 Volts, the electrode 407*m* may have a potential of −10 Volts and the electrode 407*n* may have a potential of −10 Volts. The electrodes 407*c* and the electrode 408 may each have a potential of −10 Volts (and optionally the electrode 409 may have a potential of −10 Volts). As ions enter into the first DC field (provided by the electrodes 401*a*-401*d*) along a first trajectory 405*a*, the first DC field is effective to direct the ions along a first exit trajectory that is substantially orthogonal to the entry trajectory 405*a*. The resulting path of the ions through the device 400 is a first substantially orthogonal deflection (along a first exit trajectory) from the entry trajectory 405*a* using the DC field provided by the electrodes 401*a*-401*d*. The deflected ions then enter the second DC field (provided by the electrodes 403*a*-403*d*) along the exit trajectory from the first DC quadrupole. The second DC field is effective to direct the received ions from the first DC quadrupole along a second exit trajectory that is substantially orthogonal to the first exit trajectory. Ions then exit the device 400 along an exit trajectory 405*c*.

Example 2

Figure 5:
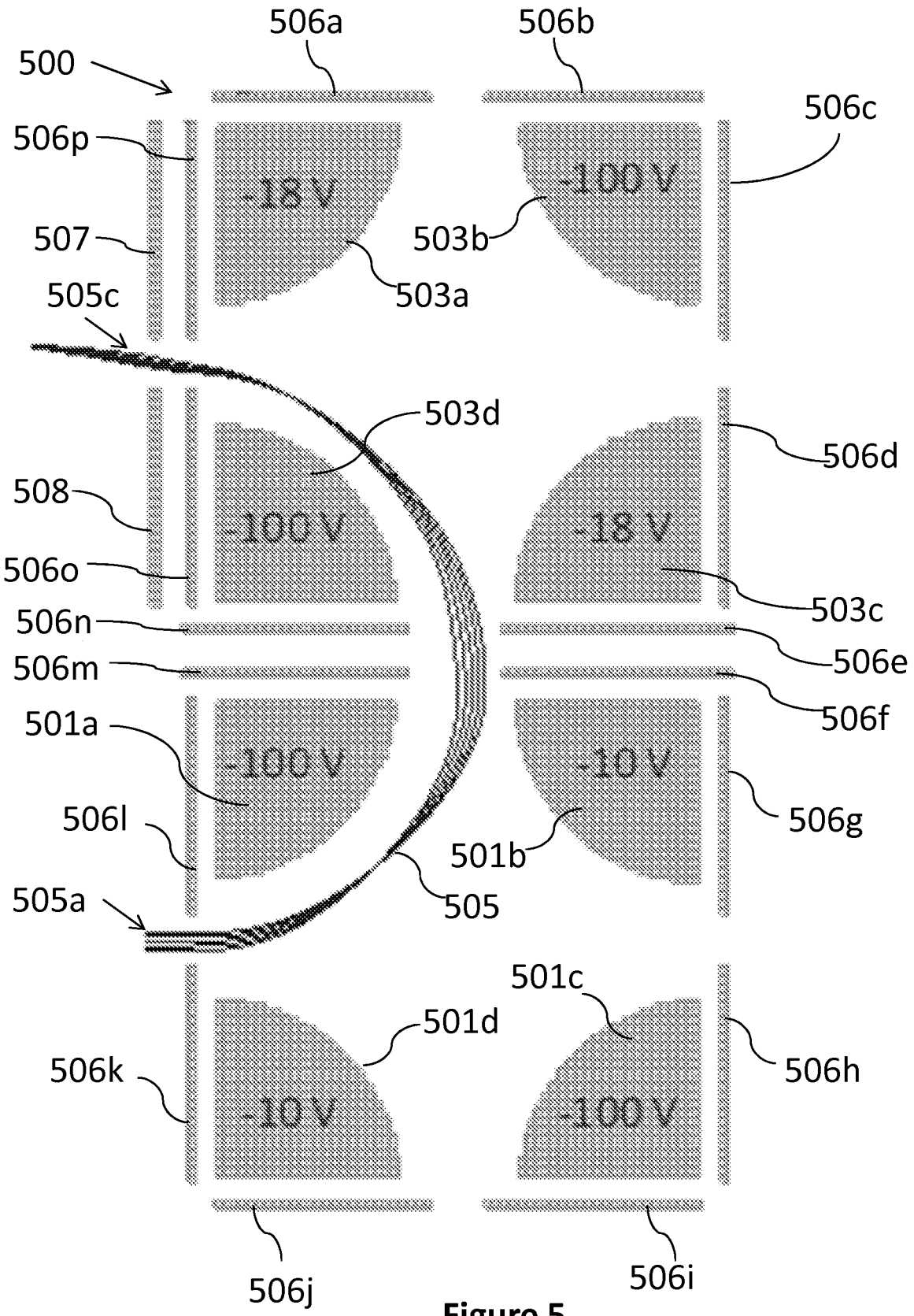
FIG. 5 is an illustration of an embodiment of an ion flow guide showing specific DC voltages applied to electrodes according to another configuration.

Referring to FIG. 5 a device 500 is shown comprising first electrodes 501*a*-501*d*, second electrodes 503*a*-503*d*, flanking electrodes 506*a*-506*p* and electrodes 507, 508, which together can function as a lens. A first DC quadrupole field is provided by applying a DC voltage to the plurality of electrodes 501*a*, 501*b*, 501*c*, and 501*d*. The voltages applied to electrodes 501*a* and 501*c* can be −100 Volts, and the voltages applied to electrodes 501*b* and 501*d* can be −10 Volts. A second DC quadrupole field is provided by applying a DC voltage to the plurality of electrodes 503*a*, 503*b*, 503*c*, and 503*d*. The voltages applied to electrodes 503*a* and 503*c* can be −18 Volts, and the voltages applied to electrodes 503*b* and 503*d* can be −100 Volts. As ions pass through the DC fields provided by the DC quadrupoles, the ions are deflected along a path approximated by the path 505 shown in FIG. 5. Electrodes 506*a*-506*p*, which comprise plate electrodes, may be used to provide a DC voltage. In the configuration shown in FIG. 5, to deflect cations with a mass of 40-90 amu along the path 505, the electrodes 506*d*, 506*g* may have a potential of −40 Volts, the electrodes 506*j* and 506*k* may have a potential of −40 Volts, the electrodes 506*m* and 506*n* may have a potential of −25 Volts, the electrodes 506*a* and 506*p* may have a potential of −40 Volts and electrode 507 (and optionally electrode 508) may have a potential of −5 Volts. As ions enter into the first DC field (provided by the electrodes 501*a*-501*d*), the first DC field is effective to direct the ions along a first exit trajectory that is substantially orthogonal to the entry trajectory. The resulting path of the ions through the device 500 is a first substantially orthogonal deflection (along a first exit trajectory) from an entry path trajectory 505*a* using the DC field provided by the electrodes 501*a*-501*d*. The deflected ions then enter the second DC field (provided by the electrodes 503*a*-503*d*) along the exit trajectory from the first DC quadrupole. The second DC field is effective to direct the received ions from the first DC field along a second exit trajectory that is substantially orthogonal to the first exit trajectory. Ions then exit the device 500 along an exit trajectory 505*c* in a substantially antiparallel direction from which the ions entered the device 500.

In the foregoing description, for purposes of explanation and not limitation, specific details are set forth, such as particular valves, configurations, devices, components, techniques, samples, and processes, etc. in order to provide a thorough understanding of the present invention. However, it will be apparent to one skilled in the art that the technology described herein may be practiced in other embodiments that depart from these specific details. Detailed descriptions of well-known valves, adsorbents, sensors, heating devices, gases, materials, analytes, configurations, devices, ranges, temperatures, components, techniques, vessels, samples, and processes have been omitted so as not to obscure the description of the present invention. As used in the foregoing description, the terms "inward," "outside," "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A method comprising:

deflecting ions of a particle beam comprising ions of interest, photons and neutrals that enter a first direct current multipole along an exit trajectory, in which the exit trajectory is substantially orthogonal to an entry trajectory of the particle beam; and deflecting the ions of interest along the exit trajectory using a second direct current multipole fluidically coupled to the first direct current multipole, wherein the second direct current multipole comprises an entrance aperture fluidically coupled to an exit aperture of the first multipole, wherein the entrance aperture of the second direct current multipole receives the ions of interest, photons and neutrals along the exit trajectory from the first direct current multipole through the exit aperture of the first direct current multipole, in which the second direct current multipole is configured to deflect the received ions of interest along a third trajectory that is substantially orthogonal to the exit trajectory to separate the received ions of interest from the received photons and the received neutrals along the exit trajectory, wherein the first direct current multipole and the second direct multipole are present in a housing of an ion flow guide, and the wherein the deflected ions of interest along the third trajectory exit the housing of the ion flow guide as an ion beam.

2. The method of claim 1, further comprising configuring each of the first direct current multipole and the second direct current multipole with a DC electric field to deflect the ions, and wherein the ions of interest are deflected along the third trajectory in the absence of any radio frequencies applied to electrodes of the first direct current multipole and to electrodes of the second direct current multipole.

3. The method of claim 1, further comprising configuring the second direct current multipole to deflect the ions of interest along the third trajectory in a direction that is substantially antiparallel to a direction of the entry trajectory.

4. The method of claim 1, further comprising configuring the second direct current multipole to deflect the ions of interest along the third trajectory in a direction that is substantially parallel to a direction of the entry trajectory.

5. The method of claim 1, further comprising focusing the ions of interest exiting along the third trajectory using at least one lens.

6. The method of claim 1, further comprising focusing the ions of interest entering an entry aperture of the first direct current multipole using a set of electrodes.

7. The method of claim 1, further comprising at least one flanking electrode positioned between the exit aperture of the first direct current multipole and the entrance aperture of the second direct current multipole.

8. The method of claim 7, comprising providing a DC potential of between −50 Volts and 0 Volts to the at least one flanking electrode.

9. The method of claim 7, comprising providing a DC potential of between −35 Volts and −10 Volts to the at least one flanking electrode.

10. The method of claim 7, wherein the at least one flanking electrode is configured as a plate electrode.

11. The method of claim 7, further comprising focusing ions exiting along the third trajectory using at least one lens.

12. The method of claim 11, wherein the lens comprises two plate electrodes.

13. A method comprising:

deflecting ions of a particle beam that enter a first multipole along an exit trajectory, in which the exit trajectory is substantially orthogonal to an entry trajectory of the particle beam;

deflecting ions along the exit trajectory using a second multipole fluidically coupled to the first multipole, in which the second multipole is configured to deflect the exit trajectory ions along a third trajectory that is substantially orthogonal to the exit trajectory; and deflecting ions along the third trajectory of the second multipole using a third multipole fluidically coupled to the second multipole, in which the third multipole is configured to deflect the third trajectory ions along a fourth trajectory that is substantially orthogonal to the third trajectory.

14. A method comprising:

deflecting ions of a particle beam that enter a first multipole along an exit trajectory, in which the exit trajectory is substantially orthogonal to an entry trajectory of the particle beam;

deflecting ions along the exit trajectory using a second multipole fluidically coupled to the first multipole, in which the second multipole is configured to deflect the exit trajectory ions along a third trajectory that is substantially orthogonal to the exit trajectory; and deflecting second ions of the particle beam that enter the first multipole along an additional exit trajectory, in which the additional exit trajectory is substantially orthogonal to an entry trajectory of the particle beam, and in which the second ions of the particle beam are of opposite charge to the ions of the particle beam.

15. The method of claim 14, further comprising a lens adjacent to an exit aperture where the second ions along the additional exit trajectory exit.

16. The method of claim 15, further comprising deflecting the ions along the exit trajectory using at least one flanking electrode.

* * * * *